United States Patent [19]

Szücs et al.

[11] 4,307,519

[45] Dec. 29, 1981

[54] METHOD AND APPARATUS FOR DRYING PRODUCTS WITH A CLOSED GAS STREAM AND A DESICCANT LIQUID

[75] Inventors: László Szücs; Andras Horvath; Emód 'Sigmond; György Waermer, all of Budapest, Hungary

[73] Assignee: Energiagazdalkodasi Intezet, Budapest, Hungary

[21] Appl. No.: 101,125

[22] Filed: Dec. 7, 1979

[51] Int. Cl.[3] ..... F26B 3/04

[52] U.S. Cl. ..... 34/27; 34/32; 34/80; 34/202; 34/223; 55/221; 261/112

[58] Field of Search ..... 261/110, 112; 55/221, 55/388; 34/73, 77, 79, 80, 32, 27, 202, 223

[56] References Cited

U.S. PATENT DOCUMENTS

| | | | |
|---|---|---|---|
| 2,952,297 | 9/1960 | Hollis | 34/119 |
| 3,257,737 | 6/1966 | Margittai . | |
| 3,257,738 | 6/1966 | Margittai . | |
| 3,738,016 | 6/1973 | Margittai . | |
| 3,857,911 | 12/1974 | Szucs et al. . | |
| 3,940,860 | 3/1976 | Unterreiner . | |
| 4,009,229 | 2/1977 | Szucs et al. . | |
| 4,189,848 | 2/1980 | Ko et al. | 34/80 |

FOREIGN PATENT DOCUMENTS

| | | |
|---|---|---|
| 317857 | 9/1974 | Austria . |
| 939336 | 4/1948 | France . |
| 168451 | 8/1977 | Hungary . |
| 1152440 | 5/1969 | United Kingdom . |
| 1363523 | 8/1974 | United Kingdom . |

OTHER PUBLICATIONS

Prospectus "Kathabar Lufttrocknung", pp. 1-11.

"Analysis & Development of Regenerated Dessiccant Systems for Industrial & Agricultural Drying", Dec. 1977, U.S. Dept. of Energy.

*Primary Examiner*—Larry I. Schwartz

*Attorney, Agent, or Firm*—Young & Thompson

[57] ABSTRACT

A method of and apparatus for drying products with a gas stream passing the product to extract moisture therefrom and a contacting device producing at least one desiccant liquid layer in the vicinity of the product to be dried, which liquid layer removes moisture from the gas. The gas stream is bubbled through a substantially horizontal liquid layer or can pass between liquid film conducting elements. The desiccant liquid is continuously regenerated. By means of several partial gas streams and a contacting device having more separated liquid film modules, a counter-current type of drying is possible. The product to be dried can be heated to a predetermined temperature by the desiccant liquid through the drying gas stream.

30 Claims, 10 Drawing Figures

METHOD AND APPARATUS FOR DRYING PRODUCTS WITH A CLOSED GAS STREAM AND A DESICCANT LIQUID

This invention relates to a method and an apparatus for drying products with a closed gas stream and with a desiccant (sorption) liquid diminishing the moisture content of the gas stream.

A well-known method for drying products is that the material to be dried is brought into direct contact with some gas, in most cases with air unsaturated with moisture, this way the material gets drier, the gas more and more saturated with moisture. Drying apparatuses in common use at present—especially the ones serving for drying a relatively big amount of products—usually dry with heated air of small relative humidity, which is released into the atmosphere after the drying had taken place. This open gas stream drying is accompanied by a significant loss of thermal energy, and it is unsatisfactory also because in some cases the products to be dried are heat-sensitive. It can also be disadvantageous because of producing air-pollution.

It was precisely the heat-sensitivity of special products (medicines, gelatine, foodstuffs, etc.) which made drying with low (e.g. environment or under environment) temperature gas necessary. The small relative humidity of low temperature gas, which is a prerequisite of effective drying of these kinds of products, can be achieved through diminishing the absolute humidity of the gas. Therefore it has been suggested e.g. in U.S. Pat. No. 3,257,737 that the drying gas should be contacted with solid adsorbents which extract the moisture content of the gas. It has also been suggested e.g. in Austrian Pat. No. 317,857 and in British Pat. No. 1,152,440 to use desiccant (hygroscopic) liquids (e.g. aqueous solution of lithium chloride or ethylene glycol) to remove the moisture from a gas. A continuous regeneration of the drying gas in this manner makes a closed gas stream also applicable. The suggested solutions utilizing a desiccant liquid cause the liquid to contact with the gas stream in sprayed or pulverized form, and the liquid particles carried away by gas stream are held back by a drip separator. Such a system from the point of view of energetics is theoretically more favourable than the one working with heated air essentially because thermal loss caused by the releasing of the air into the atmosphere is omitted. Still, up till now, closed gas circulation systems have only been used in case of special drying problems, and whenever it was possible with regard to the characteristics of the products to be dried, the open air stream method with heated air was applied. The reason for this is that the traditional type of closed gas circulating driers makes a costly investment, the circulation of very much gas is extremely energy-consuming, and the desiccant liquid used for regeneration is expensive; these latters result in high operating expenses.

It is the main object of the invention to provide a closed gas stream drier which as far as expenses are concerned is more favourable than the previous closed gas stream dryers, and is competitive with the known open air steam dryers, even in case of a big amount of products to be dried.

The invention is based on the following basic ideas:

(1) Contact between the gas stream and the desiccant liquid should not be brought about by spraying or pulverization of the liquid but with the aid of a gas-liquid contacting device placed in the path of the gas stream which allows the separation of drying space and contacting space as used until now to be eliminated.

(2) In a closed air stream circulation system the amount of air to be used for a particular purpose is a multiple of that used in an open system. For this reason, the gas contacting device using desiccant liquid and the product to be dried must be placed close to one another and in such a way that the air stream should suffer the least possible alteration in velocity and in direction in the course of the circulation.

(3) Drying must be carried out not with low but with such high temperature gas stream as is allowed by the character of the product at all. To do this it is expedient to heat the circulated gas stream by the desiccant liquid.

(4) When regenerating the desiccant liquid the evaporation heat of the steam eliminated from the liquid must be recuperated into the liquid to be regenerated with regard also to the heating needed during the regeneration.

(5) The desiccant liquid gas contacting device must be of a structure that can also be modularly arranged, and permit the application of the per se known principle of counter-current at the drying of continually moving products.

Hence, one subject matter of the invention is a method of drying products with a closed gas stream and a desiccant liquid wherein the following steps are performed: introducing the product to be dried into a drying compartment; continuously circulating a drying gas stream so as to cause it to pass the product to be dried; contacting the drying gas stream with a desiccant liquid to remove moisture from the gas; and regenerating the desiccant liquid by circulating at least a part of it through regenerating means which remove moisture therefrom. The essence of this method consists in producing at least one layer of the desiccant liquid in the vicinity of the product being in the drying compartment, and contacting the drying gas stream with said at least one desiccant liquid layer.

The application of a liquid layer according to the invention is advantageous in several respects. First, it renders unnecessary the drip separator applied in the systems known, all the same it prevents radically pollution of the gas stream by the liquid-drops, and thus it diminishes the loss of the desiccant liquid, too. Second, the coefficient of the mass transfer between the liquid and the gas is more favourable here than with liquid particles; this allows compact structure accompanied by a smaller pressure drop of the gas stream. Third, it does not demand a contacting space separated from the drying compartment; the liquid layer can be established quite close to the product to be dried. Another advantage is that bringing about a liquid layer is less delicate an operation that spraying as known from the previous solutions, because the danger of a block up is much less, and so is the need for maintenance. This latter factor is of particular significance as the gas stream often transports dust and other pollution beside moisture into the desiccant liquid, which block up the holes in the spray nozzles.

An advantageous implementation of the method according to the invention is to produce a substantially horizontal desiccant liquid layer, and bubbling the gas stream through said horizontal liquid layer. By this it is possible to dry bulk goods, for instance transported on a belt conveyor which is conducted under or above the horizontal liquid layer.

It is another extremely advantageous implementation of the method wherein at least one desiccant liquid layer is produced by causing the desiccant liquid to flow on liquid film conducting elements, and said contacting is performed by causing said drying gas stream to pass between said liquid film conducting elements. The liquid film conducting elements can be applied to form a curtain-like arrangement which may for example border the drying compartment.

Another subject matter of the invention is a method of drying product wherein the following steps are performed: introducing the product to be dried into a drying compartment; continuously circulating a drying gas stream so as to cause it to pass the product to be dried; contacting the drying gas stream with a desiccant liquid to remove moisture from the gas; and regenerating the desiccant liquid by circulating at least a part of it through regenerating means which remove moisture therefrom. The essence of this method consists in bringing about a heat exchange between the desiccant liquid and the product to be dried so that the heat is transmitted by the drying gas stream between the desiccant liquid and the product to be dried.

It is practical to raise the temperature of the desiccant liquid during regeneration to such a degree that while contacting the desiccant liquid with the drying gas stream the temperature of the gas is raised to a predetermined temperature, preferably over 40° C., for heating up the product to the degree required. This method provides for the possibility of diminishing the quantity and velocity of the gas to be circulated because at a higher temperature the quantity of moisture extractable with 1 kg air is increasing, and allows an efficient recuperation of the evaporation heat of the steam evaporated from the desiccant liquid during the regeneration into the desiccant liquid to be regenerated. A further advantage is the omission of cooling applied in the previous gas-liquid contactors: this results in a simpler construction of the gas-liquid contacting device.

According to a particular execution of this method the desiccant liquid is a desiccant solution; said regenerating is performed by evaporating the desiccant solution; and the steam evaporated from the desiccant solution is at least partly condensed by the desiccant solution to be regenerated. This permits highly economic regeneration during which energy requirement of regeneration can be reduced at a great extent by applying a multi-effect boiling or a multi-stage flash evaporation. Compared to the previous solutions where the evaporation heat of the evaporated steam is used for heating the air which is to predry the product it is an advantage that the steam condensation with a liquid requires a smaller and cheaper device than that working with air.

It is practical to boil the desiccant solution to be regenerated with the steam evaporated from the solution during regeneration. Energy requirement can be reduced through concentrating the desiccant solution by multi-effect boiling, and using the incoming solution to be evaporated for condensing at least partly the steam evaporated during the first or during the last boiling process of the regeneration.

Regeneration can be executed by heating the desiccant solution to be regenerated without making it to boil, with the steam evaporated from the solution. In this case it is particularly advantageous to regenerate the desiccant solution with a multi-stage flash evaporator.

According to a very advantageous implementation of the method of the invention, the desiccant solution is to be cooled before regeneration as a function of the cooling down of the desiccant solution during the drying process so that the desiccant solution to be regenerated is of a predetermined temperature. The cooling suggested here is vital for the control of the cycle of the desiccant solution, and is meant to complement the cooling down which occurs in the desiccant solution at contact with the drying gas stream. The degree of cooling must be altered for instance according to the season. The cooling is preferably done during regeneration.

According to another advantageous implementation of the method the continuous circulation of the drying gas stream is performed by conducting the drying gas stream in a path section between the product to be dried and the desiccant liquid so that in said path section the ratio of the maximum and minimum velocity of the drying gas stream is smaller than five to one and the alteration of the direction of the drying gas stream is less than 30 degrees. This measure results in a relatively small demand for ventilation power; this is an important point in the economy of the whole drying procedure. The ventilation power can be further diminished if the drying gas stream is conducted between the product to be dried and the desiccant liquid substantially without any alteration of velocity and direction.

It is practical to use air as drying gas and aqueous solution of calcium chloride as a desiccant solution. The calcium chloride solution is particularly profitable owing to it cheapness. The method according to the invention is applicable not only for eliminating the moisture of water but also for drying materials which contain a different kind of moisture by using an appropriate desiccant liquid. It is possible, for instance, to apply the present method for drying materials containing alcoholic moisture using closed air stream and petrol as desiccant liquid.

According to a further implementation of the method the drying gas stream consists of at least two parallel partial gas streams; the product to be dried is moved across said partial gas streams; and each of said partial gas streams is contacted with a desiccant liquid of specific concentration and temperature. In this way the drying program for the product to be dried can be extremely varied. For instance, according to a highly expedient implementation of the method, each of said partial gas streams is contacted with a more concentrated desiccant liquid than the desiccant liquid contacting the previous partial gas stream with respect to the direction of movement of the product to be dried. This results in a counter-current between the product to be dried and the desiccant liquid.

The method according to the invention can be implemented also by producing at least two separated groups of desiccant liquid films of different concentration; placing said groups of desiccant liquid films side by side in the way of said partial gas streams so that each of said gas streams is contacted with its own at least one group of desiccant liquid films. It is an advantageous implementation wherein each of said groups of desiccant liquid films is provided with own liquid circulation; the liquid circulation of the last group with respect to the direction of movement of the product to be dried is fed with the regenerated desiccant liquid coming from said regenerating means; the circulation of each preceding group is fed with the overflow of the circulation of the subsequent group; and the overflow of the circulation of the first group is conducted into said regenerating means. In this way counter-current is attained between the desiccant liquid and the product to be dried.

It is also possible to move the product to be dried across the partial gas streams and alter the temperature of the product in a prescribed manner through controlling the temperature of the desiccant liquid separately in each individual group of desiccant liquid films. In this manner the drying temperature also in case of continuous drying can easily be programmed for each phase of drying.

A further subject matter of the invention is an apparatus for drying products with a closed gas stream and desiccant liquid wherein the apparatus comprises at least one drying compartment for the product to be dried; at least one contacting device for contacting a drying gas stream with a desiccant liquid to remove moisture from the gas; gas conducting means for conducting the drying gas stream in a substantially closed path through said drying compartment and said contacting device; gas circulating means to cause the drying gas stream to circulate along said closed path; regenerating means for removing moisture from the desiccant liquid; and liquid circulating means for circulating at least a part of the desiccant liquid through said regenerating means and said contacting device. The apparatus is characterized by that said contacting device includes means for producing at least one layer of the desiccant liquid to be contacted with the drying gas stream; said at least one desiccant liquid layer is located in the vicinity of the product being in said drying compartment.

In an embodiment of the apparatus according to the invention the contacting device comprises a vessel for producing a substantially horizontal desiccant liquid layer, said vessel having on its wall bubbling caps for bubbling the drying gas stream through said liquid layer, said vessel being connected to said liquid circulating means so as to cause the desiccant liquid to flow along said vessel, and said drying compartment is located above or below said vessel. Preferably the drying compartment comprises a device for transporting the product to be dried through said drying compartment, said transporting device having openings for letting through the drying gas stream but not letting the product to be dried drop. Advantageously the transporting device is an endless belt conveyor, and said gas circulating means are ventilators placed side by side along said belt conveyor.

According to another embodiment of the apparatus the contacting device comprises liquid film conducting elements being placed so that the drying gas stream is passing between said liquid film conducting elements. A high degree of operational safety and simple structure can be achieved if the contacting device further comprises a receptacle for receiving and holding the incoming desiccant liquid, at least one pile lock to guide in film form the liquid out of said receptacle, liquid distributing means having at least one distributing surface connected to said at least one pile lock and facing downwards, and liquid outlet means, wherein said film conducting elements are connected between said liquid distributing surface and said liquid outlet means so that they conduct liquid films from said surface into said outlet means. This embodiment is not very sensitive to the pollution which might get into the desiccant liquid from the drying gas stream. It is practical to arrange the liquid film conducting elements—preferably strips or fibres—into at least one substantially vertical plain. There is an excellent heat—and mass-transfer between the desiccant liquid films created on the thin fibres and the drying gas stream. The strips or fibres can be made of a metal resistant to the desiccant liquid or of a plastic material which tolerates the highest possible temperature of the desiccant liquid.

One possible embodiment of the drying apparatus according to the invention is applicable for products as wood. This embodiment comprises a basement, a shell-roof, and a false roof provided with openings for letting through the drying gas stream and located between said basement and said shell-roof, wherein said drying compartment is located between said basement and said false roof, said gas circulating means are ventilators placed between said false roof and said shell-roof, and said contacting device is placed at said drying compartment so that said at least one vertical plain formed by said liquid film conducting elements is substantially perpendicular to the drying gas stream and extends between said basement and said false roof. In such an arrangement the liquid film gas contacting device is placed at a boundary surface or a cross-section of the drying compartment, said surface or cross-section being substantially perpendicular to the direction of the gas stream. This arrangement guarantees little pressure drop for the gas stream which results in a low energy consumption due to the ventilation.

A very advantageous embodiment of the apparatus according to the invention is wherein the contacting device consists of at least two liquid film modules placed side by side, each liquid film module has its own liquid film conducting elements and own liquid circulating device providing a liquid circulation to form the liquid films on said own conducting elements, and said liquid film modules are provided with a common liquid channel interconnecting said liquid circulating devices, said common liquid channel being connected to said liquid circulating means. Thus the apparatus has one single regenerating means belonging to it, still each liquid film module gets a desiccant liquid whose activity is different from that of the others.

According to a further embodiment the ratio of any two flow sections of said gas conducting means between said drying compartment and said contacting device is between 0.2 and 5; and said contacting device is located at said drying compartment so that the drying gas stream is flowing between the product to be dried and said contacting device with a directional change of less than 30 degrees. It is very advantageous if said flow cross section ratio is between 0.5 and 2, and said directional change is substantially zero degree, and the distance between said drying compartment and said contacting device is less than the hydraulic diameter of said gas-conducting means between them.

According to a highly profitable embodiment of the apparatus the desiccant regenerating means contain a multi-effect evaporator a multi-stage flash evaporator. It is the latter which is more expedient with regard to its simple operation. This embodiment guarantees very economical regeneration also from the point of view of energy consumption.

A further subject matter of this invention is, as an article of manufacture, the product prepared according to the present method.

Further details of the invention will be described by taking reference to the accompanying drawings which show, by way of example, embodiments of the apparatus according to the invention, and in which.

Same reference characters refer to same or similar elements throughout the drawings.

Figure 1:
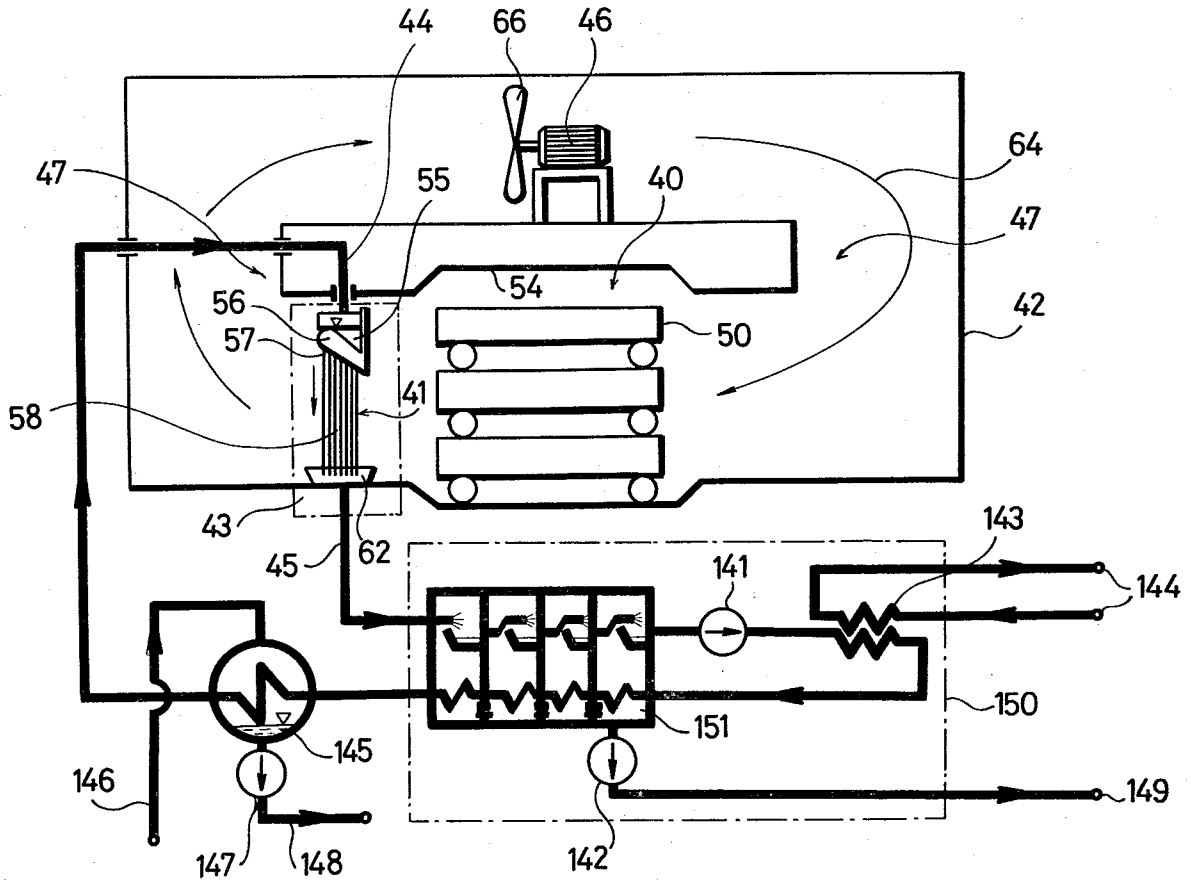
FIG. 1 is a schematic illustration of a first embodiment of a drying apparatus according to the invention.

In FIG. 1 a casing 42 of a drying apparatus is shown schematically. In the apparatus a gas stream e.g. an air stream which dries product 50, e.g. bulk goods as shown in the figure, circulates in a closed cycle in the direction of arrow 64. Circulation is forced by a ventilator 66 which is driven by an electric motor 46 placed above a false roof 54 shown schematically, without its holding means in the figure. The false roof 54 has openings 47 in it which the air stream can get through. The product 50 is situated in a drying compartment 40 under the false roof 54. After flowing through the product 50 the now wet air stream gets into a contacting device 43 which causes the air stream to contact liquid films 41 of a desiccant liquid. The desiccant liquid is circulated by a pump 141 in a regenerator 150. The active and hot desiccant liquid comes into the contacting device 43 from a pipeline 44 above, it flows into a pot-shape receptacle 55, from there over a pile lock 56 to a liquid distributing surface 57 facing downwards. From the liquid distributing surface 57 it flows down-a-long liquid film conducting elements 58, e.g. fibres, said elements conduct it to a liquid outlet channel 62, from there it departs through a pipeline 45.

The desiccant liquid diluted and cooled by the contact with the air stream flows into the regenerator 150 through the pipeline 45. The regenerator 150 displayed in the drawing as an example contains a multi-stage flash evaporator 151, a liquid circulating pump 141, a pump 142 for removing the distillate of the multi-stage flash evaporator 151 through a pipe end 149, and a heat-exchanger 143 which is fed with cooling water through pipe ends 144. Cooling in the heat-exchanger 143 is essential for the appropriate operation of the multi-stage flash evaporator 151. The active liquid leaving regenerator 150 warms up while going through condenser 145, then gets back to the contacting device 43. The condenser 145 gets the heating steam through a pipe end 146, and the condensate is carried away by a pump 147 through a pipe end 148. Elements of the regenerator 150 and the heating after the regeneration are well-known in themselves, so their detailed description is unnecessary.

The embodiment according to FIG. 1 is particularly advantageous when drying products with high heat tolerance e.g. bricks, as in this arrangement the temperature of the desiccant liquid which has returned from the contacting device 43 and has been "cooled" there is still enough for eliminating the moisture during the flashing process.

Application of the multi-stage flash evaporator 151 shown in FIG. 1 is particularly advantageous in the apparatus according to the invention because it is from the point of view of control, operation and reliability more favourable then other multi-effect evaporators of the same energetic efficiency. Here the evaporation does not take place along heat transfer surfaces, so it is less sensitive to encrustation and corrosion, and its construction does not become complicated even if energetic effectivity is improved. Naturally, an evaporator of different arrangement or construction per se known can equally be applied for the regeneration.

Similarly, to use the contacting device 43 as shown in FIG. 1 in the apparatus according to the invention is very profitale. This construction is not sensitive to the pollution getting into the liquid from the air stream, and guarantees the contact between the liquid and the air stream to have a good heat- and mass-transfer coefficient.

In the apparatus according to the invention the drying compartment can be constructed and the product 50 to be dried can be placed in many ways (suspended, fluid-bedded, geyser, chamber, tunnel or anything else). The product can be moved during the drying process and the drying gas can equally meat the products in counter-, cross- or direct-current.

Figure 2:
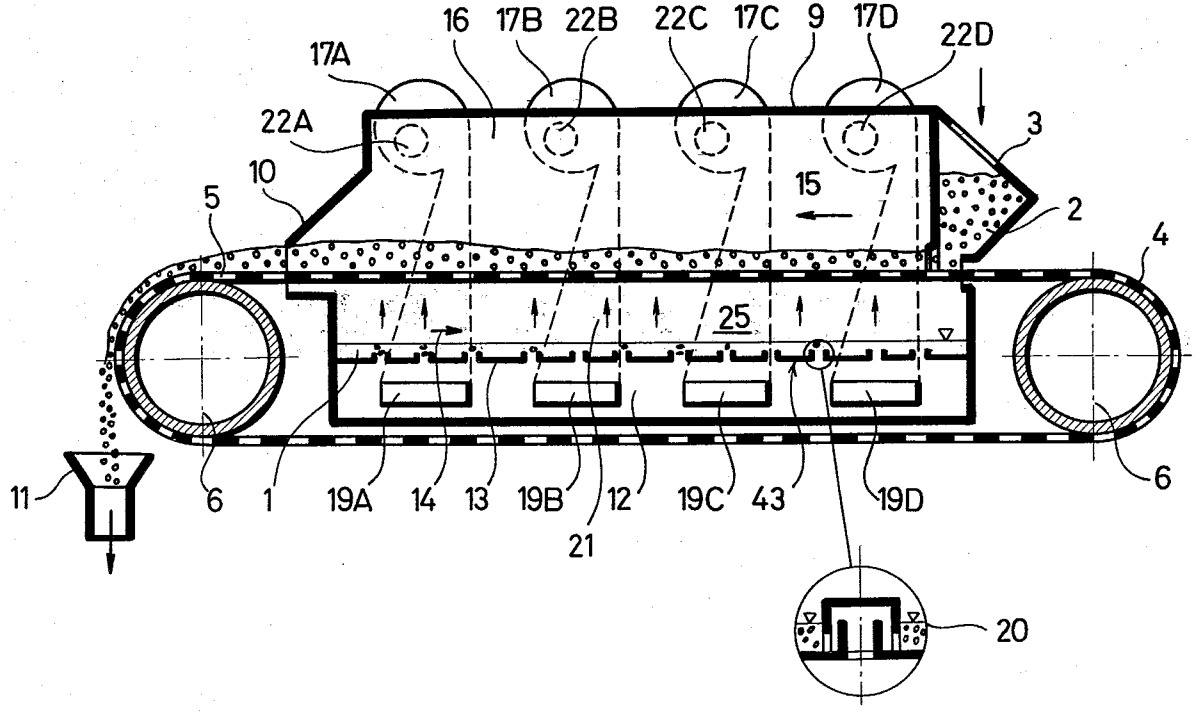
FIG. 2 is a sectional view of a second embodiment of the drying apparatus, taken along the line B—B of FIG. 4.
Figure 3:
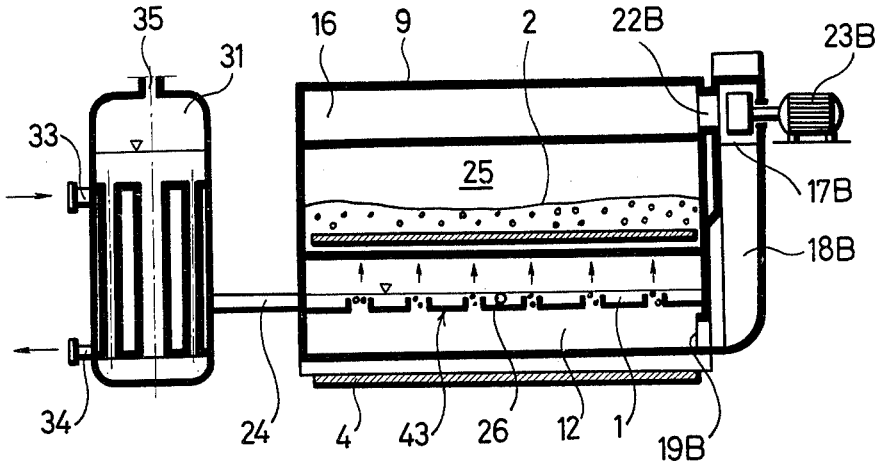
FIG. 3 is another sectional view of the second embodiment, taken along the line A—A of FIG. 4.
Figure 4:
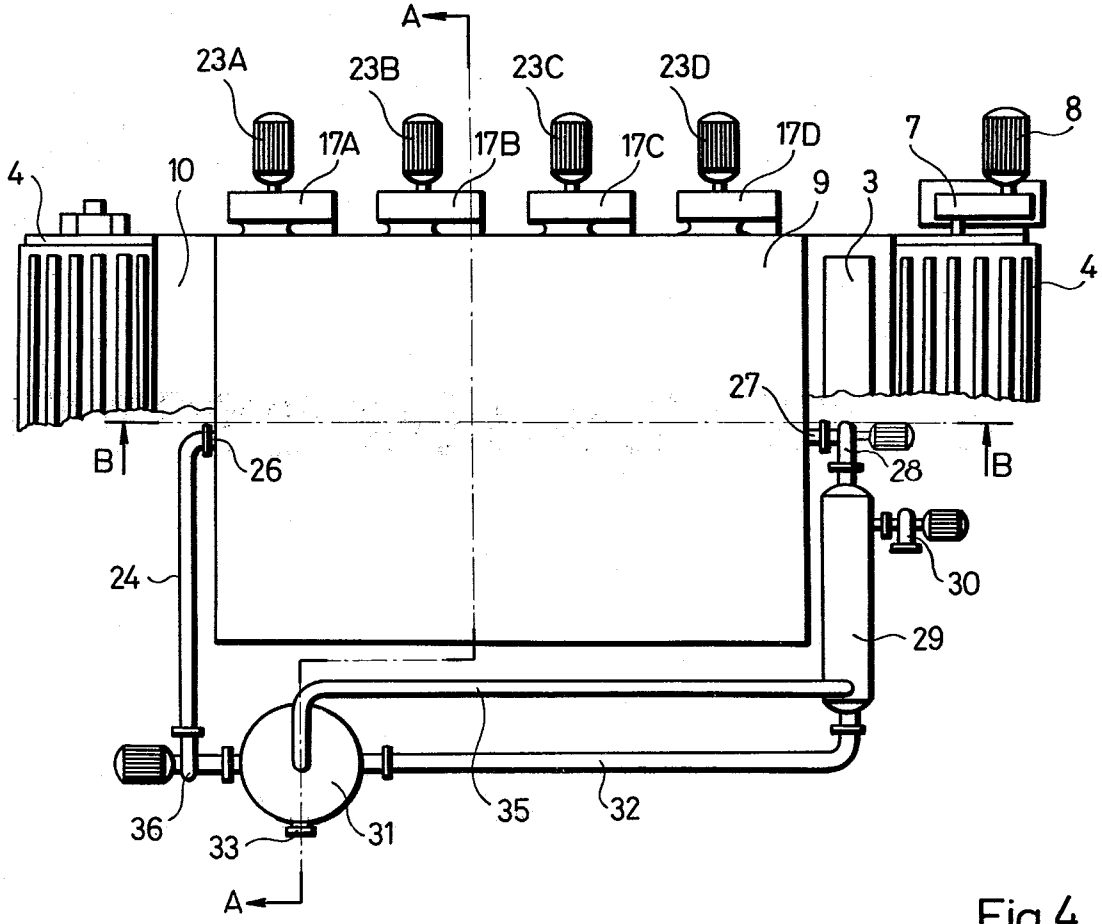
FIG. 4 is a top view of the second embodiment of the drying apparatus shown in FIGS. 2 and 3.

FIGS. 2, 3 and 4 show such an embodiment of the drying apparatus according to the invention which operates with a substantially horizontally moving liquid layer 1 and with also horizontally moving product 2 above the liquid layer. The product 2 e.g. soybean through a throat 3 gets onto a transporting device, in the drawing a belt conveyor. The belt 4 has air transmitting openings 5 in it which let the air through but prevent the product 2 from falling off. The belt 4 is held by two wheels 6 which are constructed to be capable of stretching and driving the belt, for this purpose e.g. they can be indented or rubberized. One of the wheels 6 is driven by an electric motor 8 through a driving gear 7. The loaded belt 4 of the belt conveyor transports the product 2 from the throat 3 through the drying compartment 25 which is situated in the casing 9 of the drying apparatus, then through gate 10 transports it to a collector 11 from where the dried product is transported to the place of storing or utilization by a belt conveyor or a pulley not shown in the figure. The empty strand of the belt conveyor passes under the casing 9.

In the bottom part of the casing 9, under the loaded strand of the belt conveyor there is a lower air collecting space 12, and above this but under the loaded strand of the belt conveyor there is a liquid vessel 13. In the liquid vessel 13 a desiccant liquid flows in the direction of arrow 14, opposite to the product 2 which moves in the direction of arrow 15. Above the loaded strand of the belt conveyor, in the upper part of the casing 9 there is an upper air collecting space 16. Four ventilators 17A, 17B, 17C and 17D driven by electric motors 23A, 23B, 23C and 23D, respectively suck the air from the upper air collecting space 16 through suction ports 22A, 22B, 22C and 22D, and force it through pressure tubes 18A, 18B, 18C and 18D and through openings 19A, 19B, 19C and 19D to the lower air collecting space 12. From here the air bubbles through bubbling caps 20 situated in the wall of the liquid vessel 13—one of the caps 20 is shown in a magnified form in FIG. 2—into the desiccant liquid layer 1 in the direction of arrow 21, then, leaving the liquid layer 1 through the openings 5 of the belt gets into the layer formed by the product 2 to be dried, and after going through it the air gets back to the upper air collecting space 16, thus the air circle is closed. The liquid vessel 13 which is provided with bubbling caps 20, in this embodiment functions as a contacting device 43 which brings about contact between the air stream and the desiccant liquid.

The four ventilators 17A, 17B, 17C and 17D bring about four closedly circulating partial air streams. The first partial air stream goes through suction port 22D and meets the arriving wet product 2. The second one goes through suction port 22C, the third through suction port 22B and the fourth through suction port 22A, and this last one extracts from product 2 the last part of moisture to be extracted. The desiccant liquid gets into the liquid vessel 13 through pipe-joint 26 and departs through pipe-joint 27. The arriving hot and active liquid is bubbled through by the air of the last partial air stream, and the departing, cooled and diluted liquid is bubbled through by the first partial air stream.

Using several partial air streams brought about by several ventilators 17A, 17B, 17C and 17D is not only advantageous with respect to stream conditions but also because of ensuring counter-current dyring with the product 2 and the desiccant liquid 1 moving opposite to one another. It is obvious that if there were only one single air stream circulated by one ventilator, there would be no counter-current drying in spite of the product 2 and the desiccant liquid 1 moving in opposite directions. The counter-current effect would have an optimum efficiency if there were an endless number of partial air streams circulating side by side. In this respect it is expedient to use as many partial air streams as possible at drying according to the invention.

It can be seen in FIGS. 2 to 4 that drying compartment 25 and the contacting device 43 are placed immediately above one another quasi forming two "floors" of the casing 9.

Another embodiment of the same type of arrangement, different from the embodiment shown in FIGS. 2 to 4, is that the liquid vessel 13 is placed above the loaded strand of the belt conveyor. This is advantageous when the product 2 contains such little particles as would fall into the liquid vessel 13 through openings 5 of the belt 4, and would pollute the desiccant liquid at an unfavourable degree. In such an embodiment the air stream entering through openings 19A, 19B, 19C and 19D would first go through the product 2, then through the liquid layer 1. Another advantage of this embodiment is that particles of the product 2 fallen through openings 5 of the belt 4 can be collected on the bottom of the casing 9 and from there can be transported away as dried product from time to time or continually. It is also advantageous that liquid drops which might have been carried away from the liquid layer 1 by the air stream, do not get onto product 2 but having gone through ventilators 17A, 17B, 17C and 17D can be collected in pots or in channel formed in the bottom of tubes 18A, 18B, 18C and 18D, and from there can be fed back to the liquid circle.

In the embodiment displayed in FIGS. 2 to 4 the pollution which had got into the liquid layer 1 e.g. from the product 2 through openings 5 can be eliminated with the help of a separating tank well known in itself, which is inserted into the desiccant liquid circle preferably after pipe-joint 27 in such a way for example, that the liquid pouring into the separating tank can only depart through openings placed at half-way to the full height of the liquid level in the tank. Naturally, the tank must be cleaned appropriately, the fluid must be skimmed, and deposits must be removed.

The diluted desiccant liquid, in this embodiment a desiccant solution, gets into the regenerator, in case of the embodiment shown in FIGS. 3 and 4 into a solution-condenser, which consists of a liquid circulating pump 28, a vapor condenser 29 which is cooled by the arriving diluted solution, a pump 30 for removing the distillate, a steam-heated evaporator 31 and a pump 36. The pump 28 pumps the diluted solution through condenser 29 as a cooling medium, from there the solution gets into the evaporator 31 through pipeline 32. The evaporator 31 is heated by steam through pipe-joint 33 and the condensate of the heating steam departs through pipe-joint 34. The steam evaporated from the solution gets to the condenser 29 from the evaporator 31 through a pipeline 35, there it gets condensed and the distillate is removed by the pump 30. The system of the pump 30 is such that together with the distillate it is capable of removing the non-condensable gases, too. From the evaporator 31 the condensed, active solution is pumped by a pump 36 through a pipeline 24 to the pipe-joint 26 through which it gets back to the liquid vessel 13. This desiccant solution regenerator is also shown by circuit diagram on FIG. 7 for the sake of better understanding.

Figure 8:
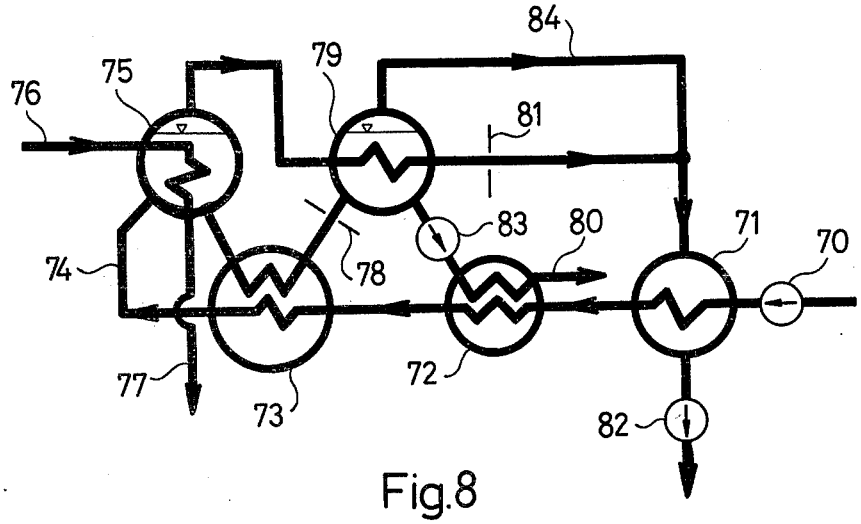
FIGS. 8 and 9 are circuit diagrams of two other desiccant liquid regenerators applicable in the drying apparatus according to the invention.
Figure 9:
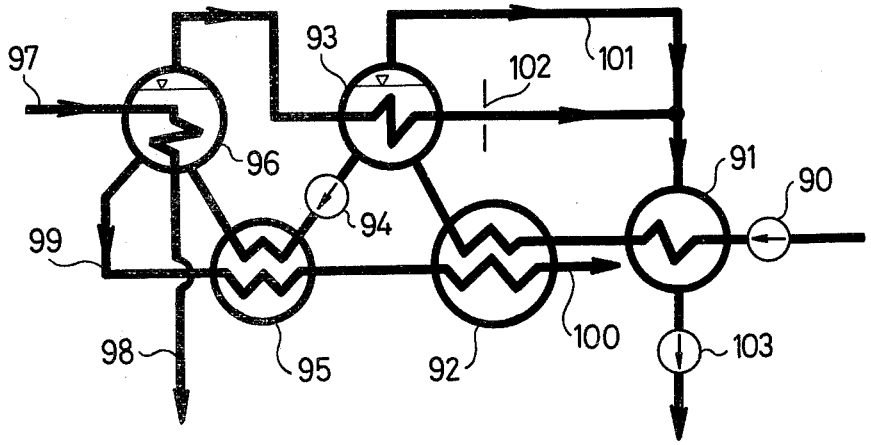
Figure 10:
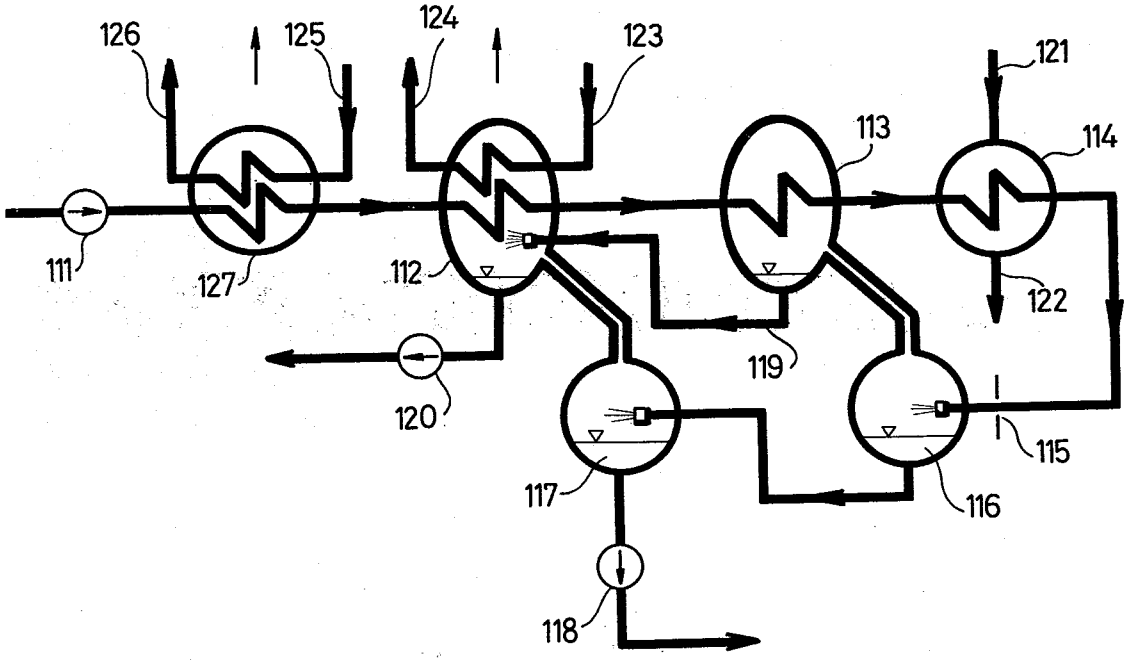
FIG. 10 is a circuit diagram of a multi-stage flash evaporator applicable as a desiccant liquid regenerator in the drying apparatus according to the invention.

In the interest of lucidity FIGS. 2 to 4 show such a simplest possible evaporator, which uses only the arriving solution to be regenerated as cooling medium for condensing the steam evaporated from the solution during the regeneration. However, according to the invention, it is more practical to use instead a multi-effect evaporator whose energetic efficiency is higher, for example as shown in FIG. 8 or 9 or a multi-stage flash evaporator, for example as shown in FIG. 1 or 10.

Naturally in place of the belt conveyor some other transporting device can equally be applied, and the product 2 can be taken through the drying compartment 25 not only horizontally but also askew. The cross-section of the liquid vessel 13 is much bigger than that of pipe-joints 26 and 27, for this reason it is practical for ensuring an even streaming picture to let the desiccant solution stream in and out of the liquid vessel 13 not only through a single incoming and outgoing pipe-joint but through many ones along the width of the vessel 13.

Figure 5:
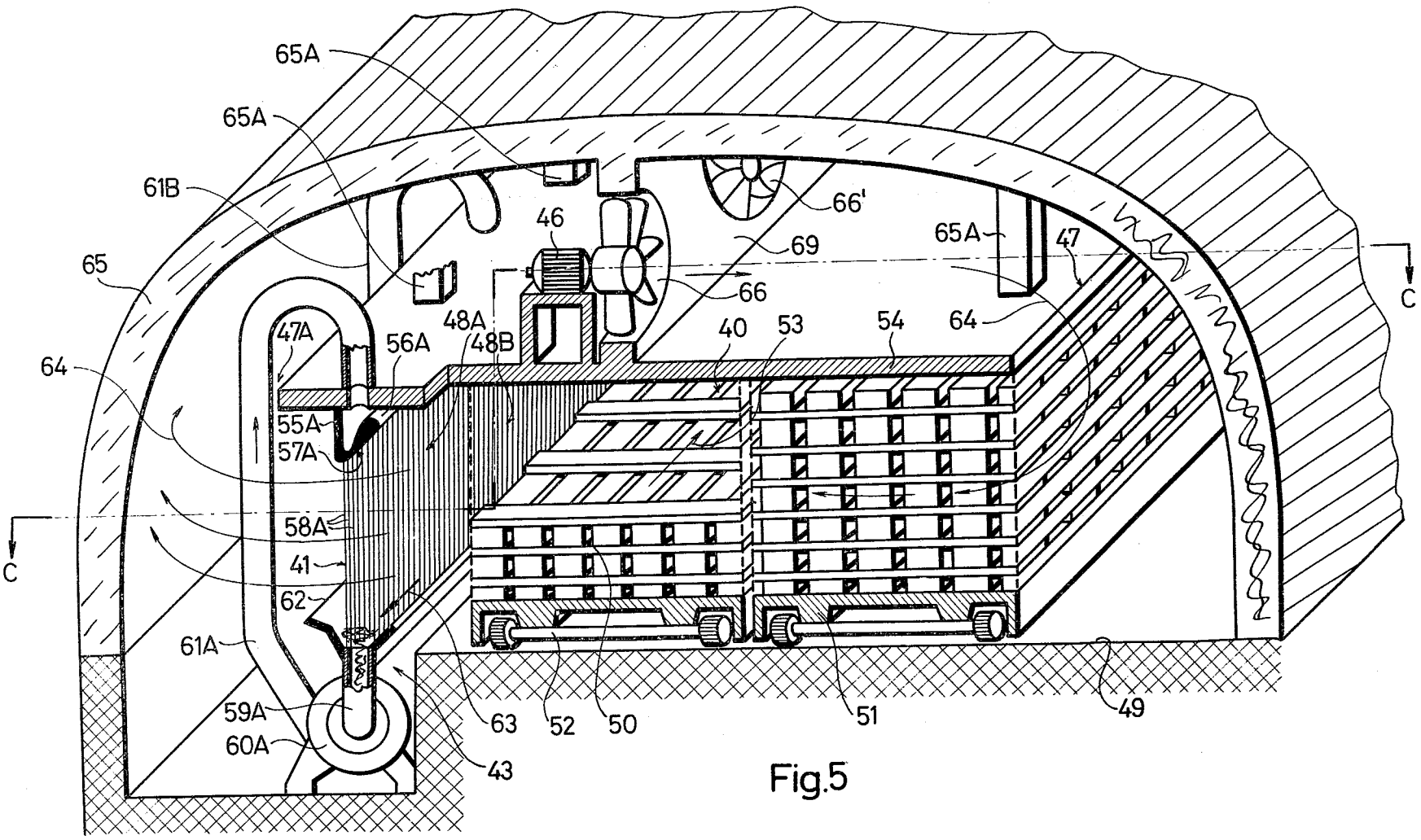
FIG. 5 is a sectional perspective view of a third embodiment of the drying apparatus.
Figure 6:
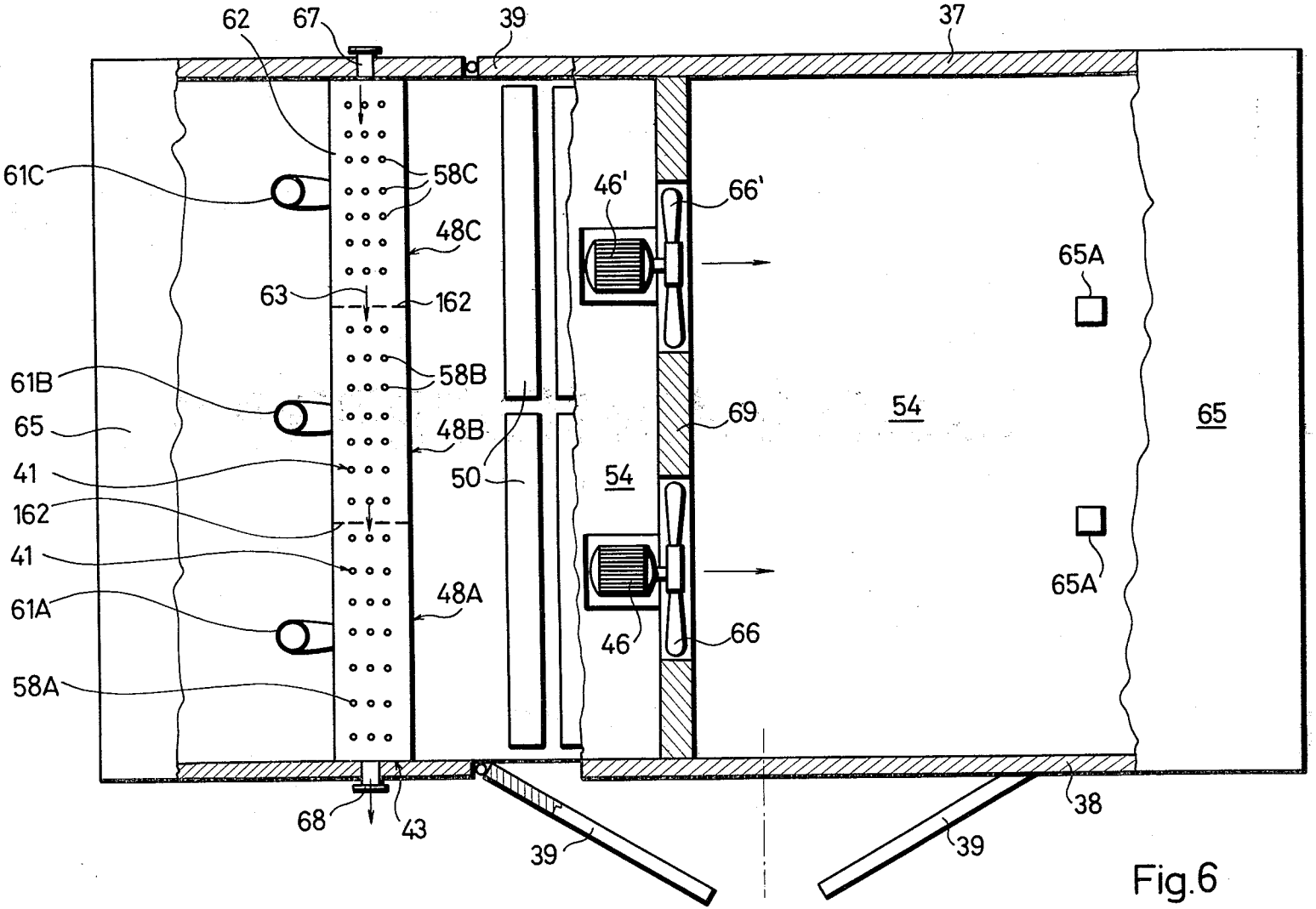
FIG. 6 is a sectional top view of the third embodiment, taken along the line C—C of FIG. 5.

FIGS. 5 and 6 show another embodiment which works with horizontally moving product 50 and a contacting device 43 placed beside the product 50, bringing about a vertical liquid film 41 of a desiccant liquid.

The product 50, sawn wood on the drawing, is put onto carriages 51 with wheels supported in bearings on axle 52, and moves very slowly forward on basement 49 in the direction of arrow 53. Above the top of the product 50 the drying compartment 40 is closed by a false roof 54.

The whole drying apparatus is closed from above by a shell-roof 65, which the false roof 54 is connected to by suspending columns 65A. The shell-roof 65 is closed on two sides by walls 37 and 38 respectively, the walls have gates 39 in them for the product 50. The air stream circulates in the direction of arrows 64 as an effect of ventilators 66 and 66' driven by electric motors 46 and 46' respectively, built into a separation wall 69. Leaving the ventilators 66 and 66' the air stream proceeds between the shell-roof 65 and the false roof 54, then through an opening 47 of the false roof 54 it goes over into the drying compartment 40 between the basement 49 and the false roof 54, from there it gets to liquid films 41 of the contacting device 43, then through another opening 47A between the shell-roof 65 and the false roof 54 back to the ventilators 66 and 66'. As in the embodiment shown there are two ventilators 66 and 66', two parallel partial air streams are going to come about.

The contacting device 43 in this embodiments as shown in FIGS. 5 and 6 consists of three liquid film modules 48A, 48B and 48C placed immediately side by side. Each module has an individual liquid circulation and all modules have a common lower liquid outlet channel 62 through which they are connected to a regenerator not shown here with pipe-joints 67 and 68. The active hot desiccant liquid coming from the regenerator enters through the pipe-joint 67, then gets more and more diluted by circulation in liquid film modules 48A, 48B and 48C as it passes the channel 62 in the direction of arrow 63, then through the pipe-joint 68 it gets into the regenerator.

The regenerator can be like the ones shown in FIG. 1 or FIG. 4 but multi-effect evaporators shown in FIGS. 8 and 9 are also suitable, and so is multi-stage flash evaporator of FIG. 10.

The liquid film modules 48A, 48B and 48C are similarly constructed, for this reason we describe the liquid film module 48A, only. An upper receptacle 55A is placed under false roof 54 and is bordered by a pile lock 56A. To the pile lock 56A a downwards directed liquid distributing surface 57A is connected. From the liquid distributing surface 57A there are liquid film conducting elements 58A, e.g. fibres as shown in the drawing, going down. Along the periphery of each of the elements 58A a liquid film comes about, all the elements 58A belonging to the liquid film module 48A together make up a liquid film group whose characteristic feature is that all the elements in the group conduct a desiccant liquid of the same concentration. The elements 58A reach down to the lower collecting channel 62 placed beneath. A suction pipe 59A starts from the bottom of the channel 62 thus conducts the desiccant liquid to a liquid circulating pump 60A. The pump 60A circulates the liquid through a tube 61A into the upper receptacle 55A, from there through the pile lock 56A it gets to the liquid distributing surface 57A, and then, along the elements 58A into the lower collecting channel 62.

The upper receptacle 55A is separated from the upper receptacle of the neighbouring liquid film module 48B, but the common lower channel 62 makes it possible that the liquid circulating circles belonging to tubes 61A, 61B and 61C give liquid to one another through it. Sections of lower channel 62 which belong to liquid film modules 48A, 48B and 48C, respectively are separated from one another by separating elements 162 provided with openings, so that the liquid stream is always flowing in the direction of arrow 63, without a mixing effect backward. Starting in the direction of arrow 63 the first liquid circulating circle belonging to the first liquid film module 48C gets the hot and active liquid from the regenerator. This is diluted by the air stream coming from the drying compartment 40, so the liquid delivered to the second liquid circulating circle belonging to the liquid film module 48B in the form of overflow of the first liquid circulating circle is somewhat diluted. It is the overflow of the last—in the drawing the third—liquid circulating circle which gets back as diluted and cold desiccant liquid to the regenerator, said liquid containing all the moisture which had been extracted from the product 50 by the air stream.

The two ventilators 66 and 66' bring about two parallel partial air streams. The velocity of each of the partial air streams should be of a value, that the liquid films along the conducting elements 58A, 58B and 58C are not disturbed by the air stream, i.e. the air stream does not carry off liquid particles from the film. A velocity of 1 to 5 m/sec is suitable. The embodiment shown in FIGS. 5 and 6—similarly to that shown in FIGS. 2 to 4—carries out a counter-current drying, as the product 50 moving slowly in the direction of arrow 53 while going through the drying compartment 40 meets air streams which had been contacted with more and more active desiccant liquid. A prerequisite of said counter-current drying here, too is to have at least two partial air streams. It is expedient to have one partial air stream belonging to each liquid film module 48A, 48B and 48C that is, the number of ventilators is equal to that of the liquid film modules.

The concentration of the desiccant liquids circulated in the liquid film modules 48A, 48B and 48C can be increased in a sequence different from that of the modules in space. The sequence can be arranged as seems best with appropriate joining of individual sections of the channel 62 belonging to individual modules. For instance, from the section of the channel 62 belonging to liquid film module 48C the desiccant liquid can get into the section belonging to liquid film module 48A instead of the one belonging to liquid film module 48B through the separating element 162, and from there into the section belonging to liquid film module 48B. In such a way the apparatus according to the invention can be programmed with regard to the drying prescriptions of the product 50 going through the drying compartment 40.

In the embodiment shown the contacting device 43 borders the drying compartment 40 on the left hand side quasi forming a "liquid curtain". As the liquid film 41 brought about according to the invention is essentially dropless, the contacting device 43 can also be placed on the right hand side of the drying compartment 40, moreover it can be placed in such a way that it divides the drying compartment 40 into two parts, e.g. between the two stacks of wood shown in FIG. 5. According to the invention, the only thing important is that the closed air stream goes through the contacting device 43 during recirculation, and the contacting device 43 and the drying compartment 40 are arranged and placed in such a way that the air stream suffers the least possible alteration of velocity and direction when going from one to the other. It is obvious that these conditions are fulfilled in all the embodiments mentioned.

The type of the contacting device 43 shown in FIG. 5 is the same as that of the one shown in FIG. 1, but it can also be made in a different way. Several contacting devices applicable in the apparatus according to the invention are described in U.S. Pat. Nos. 3,857,911 and 4,009,229, in Hungarian Pat. No. 168,451 and in British Pat. No. 1,363,523. In the apparatus according to the invention it is highly advantageous to apply aqueous solution of calcium chloride in the concentration of 40 to 50% as a desiccant liquid. The pollution getting into the desiccant solution can be eliminated with a tank in the same way as the one described in connection to the embodiments shown in FIGS. 2 to 4.

In FIGS. 5 and 6 we do not show a regenerator as it can be the same as that in any of FIGS. 1, 4, 8, 9 and 10. With the appropriate selection of regeneration it is also possible to ensure for the active solution arriving through pipe-joint 67 to be as hot as is needed so that it can heat the air stream and through it the product 50. With the help of liquid film modules 48A, 48B and 48C it is possible to set a temperature program for the product 50 going through the drying compartment 40.

FIGS. 7, 8, 9 and 10 show various solutions for the regenerator. Having considered that the regenerator comes about from different connecting of devices per se known, the various regenerators to be applied in the invention are shown in FIGS. 7, 8, 9 and 10 only with circuit diagrams. For the sake of lucidity we marked each operation with a separate schematic sign in the circuit diagrams but the invention can be realized also in such a way that, for instance, more than one device is placed into one casing.

Figure 7:
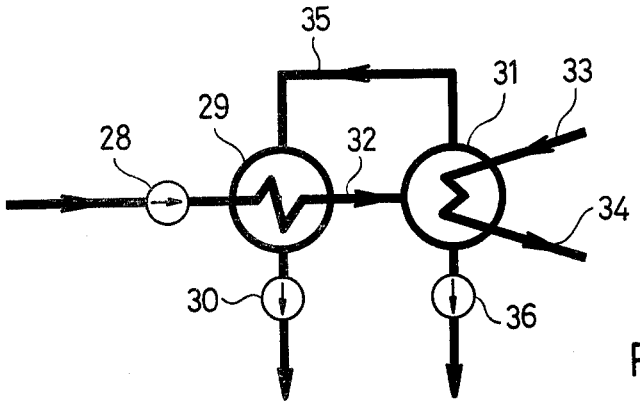
FIG. 7 is a circuit diagram of the desiccant liquid regenerator of the second embodiment as shown in FIGS. 2 to 4.

FIG. 7 represents the circuit diagram of the regenerator shown in FIGS. 2 to 4 and described in relation to these figures in detail.

FIG. 8 represents a regenerator which uses the steam evaporated from the desiccant liquid for making to boil the liquid to be regenerated, and the steam coming of the departing active liquid heats the incoming diluted liquid. This regenerator is a multi-effect evaporator.

The diluted liquid is pumped by a pump 70 into a condenser 71, there it serves as cooling medium for the condenser 71, then while cooling the liquid evaporating in heat exchangers 72 and 73 it gets warmed further, finally it gets into an evaporator 75 through a pipeline 74. This evaporator 75 is heated from the outside with heat taken in. For instance, according to the embodiment shown, steam is taken in through a pipe-joint 76, this gets condensed, and the condensate departs through a pipeline 77. Of course, flue gas, radiant heat, solar energy or something else can also be used for heating. From here through a heat exchanger 73 and a throttle 78 the liquid gets into an evaporator 79, where it is further boiled by the steam produced in the evaporator 75. From here a pump 83 pumps the liquid through the heat exchanger 72 to a pipe-joint 80 which is connected to a pipe-joint conducting the active liquid in the dryer body itself, e.g. to the pipe-joint 67 in FIG. 6. The steam produced in the evaporator 79 through a pipeline 84 and the condensate of the steam heating the evaporator 79 through a throttle 81 get in the condenser 71 and both heat there the diluted, incoming desiccant liquid. The condensed distillate and the non-condensable gases are removed by a pump 82.

FIG. 9 shows the circuit diagram of an embodiment of the regenerator which is also a multi-effect evaporator and uses the steam evaporated from the diluted liquid for heating the incoming diluted liquid to be regenerated.

The diluted liquid is pumped to a condenser 91 by a pump 90 as cooling medium, there it warms up, then cooling the departing already condensed liquid in the heat exchanger 92 it goes on warming and gets into an evaporator 93. From here a pump 94 takes it through a heat exchanger 95, where cooling the active liquid it gets warmed, further to an evaporator 96. Here it is evaporated with heat taken in from outside, for example with steam taken in through a pipe-joint 97. The condensate of the steam departs through a pipe-joint 98. The steam which had come about in the evaporator 96 boils the diluted liquid in the evaporator 93. The condensed, active liquid through a pipeline 99 gets into the heat exchanger 95, then into the heat exchanger 92, and departs through a pipe-joint 100 towards the dryer body e.g. to the pipe-joint 67 in FIG. 6. The steam produced in the evaporator 93 gets into the condenser 91 through a pipeline 101, condensate of the steam heating the evaporator 93 gets into the same place through a throttle 102, there it heats the diluted liquid, then the distillate produced by condensing and the gases not condensable are carried away by a pump 103.

FIG. 10 shows the circuit diagram of a further embodiment of the regenerator in which the heat released during condensing the steam evaporated from the liquid by flash only warms the liquid to be regenerated but does not evaporate it. This regenerator is a multi-stage flash evaporator.

The diluted liquid is driven through condensers 112, 113 and 114 by a pump 111. On leaving the condenser 114 the liquid goes through a throttle 115. The pump 111 and the throttle 115 are arranged in such a way that the pressure of the liquid when going through condensers 112, 113 and 114 is bigger than the saturation pressure all the way through, so vaporization does not occur anywhere. The temperature of the diluted liquid serving as cooling liquid in condensers 112, 113 and 114 is increasing. After the throttle 115 in an evaporator 116 steam is released from the liquid without heat transfer. This steam gets condensed in the condenser 113. The liquid goes on to an evaporator 117 where more steam is released from it which gets condensed in the condenser 112. The condensed active liquid that is left is carried back to the drying body by a pump 118, e.g. in FIG. 6 to the pipe-joint 67. The distillate condensed in the condenser 113 through a pipeline 119 gets to the condenser 112, where it flashes. The distillate and the non-condensable gases are pumped away by a pump 120.

In the condenser 114 the diluted liquid to be regenerated should be heated by heat taken in from outside, for example with steam taken in through a pipe-joint 121, the condensate of the steam departs through a pipe-joint 122.

With respect to the control of equipments of the regenerator it is expedient to alter the embodiments described above in such a way that only a part of the diluted desiccant liquid gets concentrated and the other part is mixed with the concentrated part. It is this mixture which has to be used as active desiccant liquid in the drying body.

For the sake of simpler description in the embodiment above we showed two evaporators i.e. two stages only, but of course it is possible and advisable in the interest of increasing the energetic efficiency to apply more stages.

In FIG. 10 it is shown that when the surplus heat produced by the regenerator cannot be utilized in the drying body or when the heat loss of the drying body is little (e.g. in summer) the desiccant liquid regenerating system should be balanced. In FIG. 10 there are two expedient solutions applicable separately but also together. As to the first solution the condenser 112 must be provided with cooling medium from the outside e.g. cooling water and coolable subsidiary surface e.g. coil pipe. This latter can be placed in a separate casing, in such a case the steam spaces must be connected with pipelines. Cooling water can for example enter the heat exchanger through a pipe-joint 123 and leave it through a pipe-joint 124. According to the second solution the diluted liquid entering the condenser 112 is pre-cooled in a heat exchanger 127 which is cooled by a medium e.g. water entering through a pipe-joint 125 and leaving through a pipe-joint 126.

In the embodiments according to FIGS. 7, 8 and 9 these two solutions are also applicable. In this respect an equivalent of the condenser 112 cooled additionally in FIG. 10 is the condenser 29 in FIG. 7, the condenser 71 in FIG. 8 and the condenser 91 in FIG. 9. The heat exchanger 127 shown in FIG. 10 must be inserted between the condensers 29, 71 and 91 and the pumps 28, 70 and 90 of FIGS. 7, 8 and 9, respectively situated before said condensers.

As various changes might be made in the embodiments herein disclosed without departing from the spirt of the invention, it is understood that all matter herein shown or described should be deemed illustrative and not by way of limitation.

What is claimed is:

1. In a method of drying products comprising the steps of introducing the product to be dried into a drying compartment; continuously circulating a drying gas stream in a closed cycle so as to cause it to pass the product to be dried; contacting the drying gas stream with a desiccant liquid to remove moisture from the gas; and regenerating the desiccant liquid by circulating at least a part of it through regenerating means which remove moisture therefrom; and improvement comprising producing at least one continuous layer of the desiccant liquid in the drying compartment, and conducting said contacting so that said at least one continuous desiccant liquid layer is substantially perpendicular to the direction of the flow of the drying gas stream in the drying compartment.

2. The method according to claim 1, in which said at least one desiccant liquid layer is a substantially horizontal liquid layer, and said drying gas stream is bubbled through said substantially horizontal liquid layer.

3. The method according to claim 1, in which said at least one desiccant liquid layer is produced by causing the desiccant liquid to flow on liquid film conducting elements arranged in at least one plane at the boundary of or within the drying compartment, and said contacting is performed by causing said drying gas stream to pass between said liquid film conducting elements.

4. The method according to claim 1, in which said desiccant liquid is a desiccant solution; said regenerating is performed by a multi-effect evaporation of the desiccant solution; and the steam evaporated from the desiccant solution is at least partly condensed by the desiccant solution to be regenerated.

5. The method according to claim 4, in which the steam evaporated during the first boiling of the desiccant solution is at least partly condensed by the incoming desiccant solution to be regenerated.

6. The method according to claim 4, in which the steam evaporated during the last boiling of the desiccant solution is at least partly condensed by the incoming desiccant solution to be regenerated.

7. The method according to claim 1, in which said desiccant liquid is a desiccant solution, and said regenerating is performed by multi-stage flashing.

8. The method according to claim 4, further comprising the step of cooling the desiccant solution after said contacting and before said regenerating in dependence of the cooling of the desiccant solution during said contacting so that the incoming desiccant solution to be regenerated is of a predetermined temperature.

9. The method according to claim 1, in which said continuous circulation of the drying gas stream is performed by conducting the drying gas stream in a path section between the product to be dried and the desiccant liquid so that in said path section the ratio of the maximum and minimum velocity of the drying gas stream is smaller than five to one and the alteration of the direction of flow of the drying gas stream is less than 30 degrees.

10. The method according to claim 9, in which said drying gas stream is conducted between the product to be dried and the desiccant liquid substantially without any alteration of velocity and direction.

11. The method according to claim 7, in which said desiccant solution is an aqueous solution of calcium chloride, and the drying gas is air.

12. In a method of drying products comprising the steps of moving the product to be dried through a drying compartment; continuously circulating a drying gas stream in a closed cycle so as to cause it to pass the product to be dried; contacting the drying gas stream with a desiccant liquid to remove moisture from the gas; and regenerating the desiccant liquid by circulating at least a part of it through regenerating means which remove moisture therefrom; the improvement comprising producing at least one layer of the desiccant liquid and bringing about a continuous heat exchange between the desiccant liquid layer and the product to be dried by heating the desiccant liquid in the course of said regenerating and then contacting the desiccant liquid with said drying gas to cool the desiccant liquid and heat the drying gas to at least 40° C. in the course of said contacting.

13. The method according to claim 12, further comprising the step of producing said at least one layer of the desiccant liquid in the vicinity of the product being in the drying compartment so that said at least one desiccant liquid layer is disposed substantially perpendicularly to the direction of flow of the drying gas stream in the drying compartment.

14. In an apparatus for drying products comprising at least one drying compartment for the product to be dried; at least one contacting device for contacting a drying gas stream with a desiccant liquid to remove moisture from the gas; gas conducting means for conducting the drying gas stream in a substantially closed path through said drying compartment and said contacting device; gas circulating means to cause the drying gas stream to circulate along said closed path; regenerating means for removing moisture from the desiccant liquid; and liquid circulating means for circulating at least part of the desiccant liquid through said regenerating means and said contacting device; the improvement in which said contacting device (43) includes means (13, 58) for producing at least one continuous layer (1, 41) of the desiccant liquid to be contacted with the drying gas stream; said contacting device (43) being located at the boundary of or within said drying compartment (25, 40) and said at least one continuous layer being disposed substantially perpendicularly to said path for conducting said drying gas stream in said drying compartment (25, 40).

15. The apparatus according to claim 14, in which said contacting device comprises a vessel (13) for producing a substantially horizontal desiccant liquid layer (1), said vessel (13) having on its wall bubbling caps (20) for bubbling the drying gas stream through said liquid layer (1), said vessel (13) being connected to said liquid circulating means (36) so as to cause the desiccant liquid to flow along said vessel, and said drying compartment (25) is located above or below said vessel (13).

16. The apparatus according to claim 15, in which said drying compartment (25) comprises a device (4) for transporting the product (2) to be dried through said drying compartment, said transporting device (4) having openings (5) for letting through the drying gas stream, but not letting the product (2) to be dried drop.

17. The apparatus according to claim 16, in which said transporting device is an endless belt conveyor (4), and said gas circulating means are ventilators (17A, 17B, 17C, 17D) placed side by side along said belt conveyor (4).

18. The apparatus according to claim 14, in which said contacting device (43) comprises liquid film conducting elements (58) being placed so that the drying gas stream is passing between said liquid film conducting elements (58), said liquid film conducting elements (58) being arranged in at least one substantially vertical plane at the boundary of or within said drying compartment (40), said vertical plane being substantially perpendicular to the direction of the flow of the drying gas stream.

19. The apparatus according to claim 18, in which said contacting device (43) further comprises a receptacle (55) for receiving and holding the incoming desiccant liquid, at least one pile lock (56) to guide in film form the liquid out of said receptacle (55), liquid distributing means having at least one distributing surface (57) connected to said at least one pile lock (56) and facing downwards, and liquid outlet means (62), wherein said film conducting elements (58) are connected between said liquid distributing surface (57) and said liquid outlet means (62) so that they conduct liquid films (41) from said surface (57) into said outlet means (62).

20. The apparatus according to claim 18, in which said contacting device (43) consists of at least two liquid film modules (48A, 48B, 48C) placed side by side, each liquid film module (e.g. 48A) has its own liquid film conducting elements (e.g. 58A) and own liquid circulating device (e.g. 60A, 61A) providing a liquid circulation to form the liquid films on said own conducting elements, and said liquid film modules (48A, 48B, 48C) are provided with a common liquid channel (62) interconnecting said liquid circulating devices, said common liquid channel (62) being connected to said liquid circulating means (e.g. 36), and said gas circulating means (66, 66'; 17A, 17B, 17B, 17C, 17D) being adapted for circulating at least two parallel partial gas streams.

21. The apparatus according to claim 14, in which the ratio of any two flow cross sections of said gas conducting means (37, 38, 49, 54) between said drying compartment (40) and said contacting device (43) is between 0.2 and 5; and said contacting device (43) is located at said drying compartment (40) so that the drying gas stream is flowing between the product (50) to be dried and said contacting device (43) with a directional change of less than 30 degrees.

22. The apparatus according to claim 21, in which said flow cross section ratio is between 0.5 and 2, and said directional change is substantially zero degree.

23. The apparatus according to claim 21, in which the distance between said drying compartment (40) and said contacting device (43) is less than the hydraulic diameter of said gas conducting means (37, 38, 49, 54) between them.

24. The apparatus according to claim 14, in which said regenerating means (150) comprises a multi-effect evaporator (e.g. 70 to 84).

25. The apparatus according to claim 14, in which said regenerating means (150) comprises a multi-stage flash evaporator (151).

26. In an apparatus for drying products comprising at least one drying compartment for the product to be dried; at least one contacting device for contacting a drying gas stream with a desiccant liquid to remove moisture from the gas; gas conducting means for conducting the drying gas stream in a substantially closed path through said drying compartment and said contacting device; gas circulating means to cause the drying gas stream to circulate along said closed path; regenerating means for removing moisture from the desiccant liquid; and liquid circulating means for circulating at least a part of the desiccant liquid through said regenerating means and said contacting device; the improvement comprising a basement (49), a shell-roof (65), and a false roof (54) provided with openings (47, 47A) for letting through the drying gas stream and located between said basement (49) and said shell-roof (65); said drying compartment (40) being located between said basement (49) and said false roof (54); said gas circulating means (66, 66') being placed between said false roof (54) and said shell-roof (65); said contacting device (43) comprising liquid film conducting elements (58A, 58B, 58C); said contacting device (43) being placed at said drying compartment (40) so that said liquid film conducting elements (58A, 58B, 58C) are arranged in at least one substantially vertical plane, said plane being substantially perpendicular to the direction of flow of the drying gas stream and extending between said basement (49) and said false roof (54).

27. The apparatus according to claim 26, in which said contacting device (43) consists of at least two liquid film modules (48A, 48B, 48C) placed side by side, each liquid film module (e.g. 48A) has its own liquid film conducting elements (e.g. (58A) and own liquid circulating device (e.g. 60A, 61A) providing a liquid circulation to form the liquid films on said own conducting elements, and said liquid film modules (48A, 48B, 48C) are provided with a common liquid channel (62) interconnecting said liquid circulating devices, said common liquid channel (62) being connected to said liquid circulating means (e.g. 36), and said gas circulating means (66, 66'; 17A, 17B, 17C, 17D) being adapted for circulating at least two parallel partial gas streams.

28. The apparatus according to claim 26, in which said regenerating means (150) comprises a multi-effect evaporator (e.g. 70 to 84).

29. The apparatus according to claim 26, in which said regenerating means (150) comprises a multi-stage flash evaporator (151).

30. In a method of drying products comprising the steps of moving the product to be dried through a drying compartment; continuously circulating a drying gas stream so as to cause it to pass the product to be dried; contacting the drying gas stream with a desiccant liquid to remove moisture from the gas; and regenerating the desiccant liquid by circulating at least a part of it through regenerating means which remove moisture therefrom; the improvement wherein said drying gas stream consists of at least two parallel partial gas streams; the product to be dried is moved acress said partial gas streams; and each of said partial gas streams is contacted with a desiccant liquid of different specific concentration and temperature; each of said partial gas streams being contacted with a more concentrated desiccant liquid than the desiccant liquid contacting the previous partial gas stream with respect to the direction of movement of the product to be dried; producing at least two separated groups of desiccant liquid films of different concentration; placing said groups of desiccant liquid films side by side in a way of said partial gas streams so that each of said partial gas streams is contacted with its own at least one group of desiccant liquid films; each of said groups of desiccant liquid films being provided with its own liquid circuit; the liquid circuit of the last group with respect to the direction of movement of the product to be dried being fed with the regenerated desiccant liquid coming from said regenerating means; the circuit of each preceding group being fed with the overflow of the circuit of the subsequent group; and the overflow of the circuit of the first group being conducted into said regenerating means.

* * * * *